United States Patent [19]

Matsumoto et al.

[11] Patent Number: 4,525,609

[45] Date of Patent: Jun. 25, 1985

[54] TIMER APPARATUS

[75] Inventors: Akio Matsumoto; Takao Yamada, both of Osaka, Japan

[73] Assignee: Matsushita Electric Co., Ltd., Osaka, Japan

[21] Appl. No.: 550,294

[22] Filed: Nov. 9, 1983

[30] Foreign Application Priority Data

Nov. 10, 1982 [JP] Japan ..... 57-197997

[51] Int. Cl.[3] ..... H01H 7/00

[52] U.S. Cl. ..... 200/38 R; 200/38 BA; 200/38 D

[58] Field of Search ..... 200/38 A, 38 BA, 38 CA, 200/38 D, 38 DA, 38 FB, 38 R, 35 R, 37

[56] References Cited

U.S. PATENT DOCUMENTS

| | | | |
|---|---|---|---|
| 3,190,976 | 6/1965 | Ellis et al. | 200/38 A |
| 3,588,394 | 6/1971 | Koch | 200/38 FB X |
| 4,311,886 | 1/1982 | Rulesh | 200/38 BA X |
| 4,436,969 | 3/1984 | Motoki | 200/38 R |
| 4,442,326 | 4/1984 | Wagle | 200/38 R |

FOREIGN PATENT DOCUMENTS

| | | | |
|---|---|---|---|
| 150790 | 4/1937 | Austria | 200/38 A |
| 1270977 | 7/1961 | France | 200/38 R |
| 2097589 | 11/1982 | United Kingdom | 200/38 A |

*Primary Examiner*—G. P. Tolin
*Attorney, Agent, or Firm*—Koda and Androlia

[57] ABSTRACT

A time switch driven by an electric clock motor is disclosed. The time switch has a base plate above which a time dial with on and off-trippers are rotatably mounted. Disposed below the base plate are other components including input and output terminals, switch means electrically connected between the terminals, switch activating means for closing and opening the switch means in accordance with the positions of the on- and off-trippers on the rotating time dial, and gear train leading from a rotor of the motor to the time dial. The motor comprises the rotor which is a bipolarized permanent magnet and an electromagnet in the form of a ring interrupted by a gap in which the rotor is located. In the base plate there is formed a generally annular groove for receiving the electromagnet, such that the electromagnet, a constituent of the motor, is received within the thickness of the base plate to reduce the depth required for the motor disposed below the plate. The components of various kinds to be disposed below the base plate are arranged to be packed together substantially in the same plane parallel to the base plate to reduce the depth required therefor. These space saving structures are combined to reduce the depth or thickness of the whole time switch assembly.

7 Claims, 16 Drawing Figures

14
17
15
16
17
73
75
71
72
76
74
70
59
46
87
50
44
42
43
41
40
81
88
82
80
103
84
92
90
87
3
86
83
85
98
47
99
101
1
91
102
97
114
115
6
113
110
20
23

TIMER APPARATUS

BACKGROUND OF THE INVENTION

1. Field of the Invention

This invention is directed to a timer apparatus, more particularly to a timer apparatus controlled by an electric clock motor for connecting an electrically operated device for a predetermined time period.

2. Prior Art

There have been provided a large variety of time switches of the type controlled by an electric clock motor as disclosed, for example, in the Japanese Utility model early publication (Kokai) No. 51-92678. However, the electric motor which is usually mounted below a base plate will occupy much space in thickness and cause the whole assembly to become thicker. In the meanwhile, when the time switch is required to be installed directly on an electric device to be controlled thereby, it is highly desired to have a decreased thickness so as to prevent the overall device from becoming bulky. Further, when the time switch is required to be mounted on a control panel together with other devices, the thickness, particularly that of the part including the motor and projecting below the base plate is mostly desired to have as little thickness as possible so that the part below the base plate, and therefore positioned below the panel, will not obstruct other devices likewise mounted on the panel. Still in the case of the time switch being used on a printed circuit board together with other electric components, too much thickness of the time switch will render the switch itself practically impossible to be mounted on the printed circuit board.

SUMMARY OF THE INVENTION

The above disadvantages or drawbacks have been eliminated by the present invention which includes an electric clock motor mounted on a base plate for rotatably driving a time dial with on- and off-trippers and a switch means being electrically connected between input and output terminals on the undersurface of the base plate. Also included in the time switch is a switch activating means fixedly mounted on the undersurface of the base plate to open the switch when one part of it comes into contacting engagement with the on-tripper on the rotating time dial and to close the switch means when another part comes into contacting engagement with the off-tripper on the time dial. The clock motor employed is a synchronous motor which comprises a rotor which is a bipolarized permanent magnet and an electromagnet ring composed of a ring core interrupted by a gap within which the rotor is disposed and a coil wound therearound. Said base plate is provided with an annular groove concentric with the rotational axis of the time dial for receiving therein said electromagnet. The groove is located above the undersurface of the base plate such that the electromagnet received therein will not add extra thickness to the space required below the base plate, such space being for a speed reduction gear train interconnecting the motor and the time dial, the switch means, the switch activating means, motor driving circuit means, and the input and output terminals, all packed closely in a coplanar arrangement below the base plate. With this arrangement, the components including the motor can be packed within a reduced thickness so as to make the time switch assembly thinner, which is highly suitable for the time switch of the type to be installed on an electric device to be controlled thereby, on a control panel, or on a printed circuit board.

Accordingly, it is a primary object of the present invention to provide a clock motor driven time switch which is compact in thickness to occupy little space and therefore well adapted to be installed directly on the electric device to be controlled thereby, the control panel, and the printed circuit board.

In a preferred embodiment of the present invention, the annular groove has a diameter slightly smaller than the time dial and the one end portion of the ring core is bent radially inwardly to form a generally V-shaped portion which is cooperative with the opposite end portion to define therebetween the gap for the rotor. These structures cause the electromagnet to present the motor with powerful driving performance sufficient for driving the time dial, while the electromagnet lies within the diameter of the time dial.

It is therfore another object of the present invention is to provide a time switch which is compact yet assures sufficient motor output for rotating the time dial and operation of the switch.

Also disclosed in the present invention is an improved feature of a clock added on the time dial. The clock includes a face plate fixed concentrically on the time dial, a minute hand being driven by the minute shaft which in turn is driven by the motor through the reduction gear train and which extends upwardly through the face plate, and a hour hand coupled to the minute shaft by a frictional coupling permitting the eccentrically rotational movement of the hour hand about the axis of the minute shaft as it rotates. The face plate has in its upper surface an annular recess which is concentric with the minute shaft and has on its inner wall a stationary gear which meshes with the stationary gear. The internal gear is shaped to have a center axis eccentric to the minute shaft to establish a so-called planocentric drive connection between the stationary gear on the side of fixed face plate and the internal gear on the hour hand, such that hour hand will move one increment for each revolution of the minute hand. This enables the hour hand to be operated without providing additionl gears below the base plate, such gears would otherwise require an additional space below the base plate and therefore act to increase the depth therebelow and/or width of the space for receiving the gear train. In addition to the above, the internal gear and stationary gear for driving the hour hand are located substantially within the thickness of the face plate, thereby requiring no additional space for these gears above the base plate such that the overall thickness of the time switch can be designed to be a minimum.

It is therefore a further object of the present invention to provide a time switch which has the hour hand as well as the minute hand but can be designed to have a reduced thickness or compact configuration.

The switch activating means employed comprises an actuating lever and a retaining lever, both pivotally mounted on the base plate. The actuating lever has a first leading edge lied in the round path of the on-tripper and has an actuator end being juxtaposed to the switch means such that it pivots to be in an on-position when the switch means is closed by the actuator end when the first leading edge comes into contact with the on-tripper on the rotating time dial. The retaining lever has a second leading edge lying in the path of the off-tripper on the time dial, and has a latch edge which engages with a portion of the actuating means to lock it in the on-position until the second leading edge is brought into contact with the off-tripper to disengage the actuating lever. Upon this disengagement, the actuating lever is returned to an off-position where the switch means is released by the actuator end to open. With this arrangement of the switch activating means, secure operation of the switch by the on and off-tripper can be attained and therefore it is a another object of the present invention to provide a time switch with good stability in its on-off operation.

The present invention discloses a still further characteristic in that a manual switch handle is included for manually closing and opening the switch means. The manual switch handle is provided on the base plate to be movable in an arcuate path along the periphery of the time dial and has first and second trip ends corresponding in their operation respectively to said on and off-trippers. When the manual switch handle is moved in one direction, the first trip end engages said actuating lever to bring it into the on-position, and when the manual switch handle is moved in the opposite direction, the second trip end engages the retaining lever to release the actuating lever, whereby the actuating lever is returned to its off-position.

It is therefore a still further object of the present invention to provide a time switch which is capable of being manually operated using the same structure for automatic on-off operations and consequently is advantageous for testing the functions of the switch activating means.

In the present invention, there is disclosed more advantageous features such as easy installation of the time switch on a panel and the like, and easy assembling performance thereof. Such easy installation results from a generally D-shaped back cap enclosing the parts below the base plate and being adaptable in a conventional and easy-formable round hole in the panel and the like. The above easy assembling feature is due to an improved structure of the annular groove for the electromagnet of the clock motor, the groove is formed between a pair of upwardly extending ribs on the base plate to have a bottom closed by the base itself, which eliminate the necessity of any additional insulating sheet material for insulating the electromagnet from the electrical components disposed just below the base plate, reducing the number of parts for the time switch and making it easier to assemble.

These and other objects and advantages of the present invention will become more apparent from the detailed description thereon taken with the accompanying drawings.

DETAILED DESCRIPTION OF THE INVENTION

Figure 1:
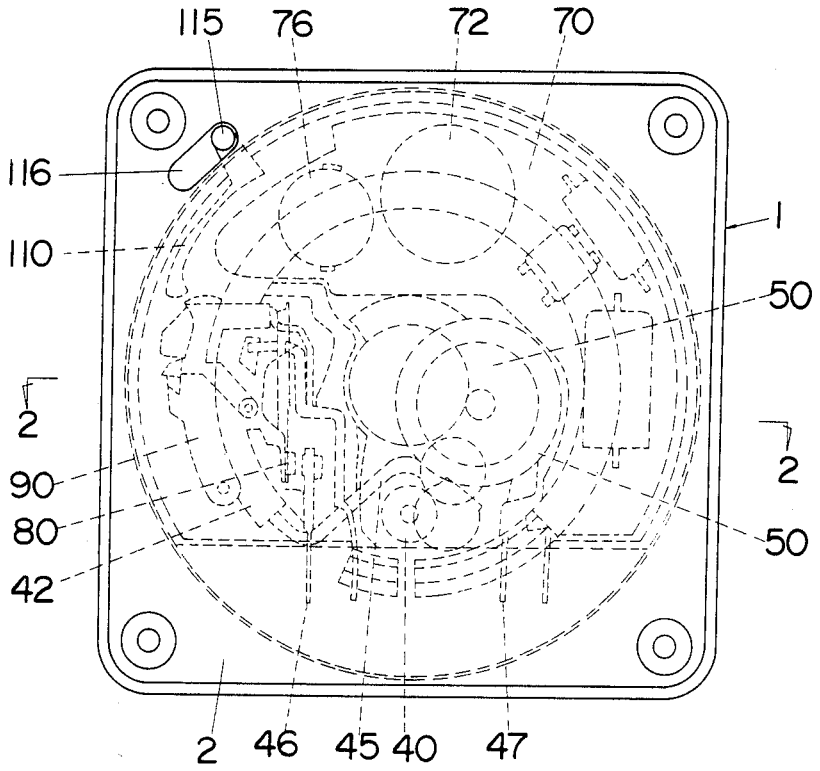
FIG. 1 is a somewhat diagrammatic plane view illustrating the internal structure of a time switch in accordance with one preferred embodiment of the present invention.

Referring now to the drawings and particularly to FIGS. 1 through 3 and 6, there is illustrated one preferred embodiment of a time switch which comprises a square base plate 1 of electrically insulating material, a time dial 20 overlying the base plate 1 to be rotatably and concentrically mounted thereon, and an electric clock motor 40 for driving the dial 20 to rotate about the center axis of the base plate 1. The base plate 1 has on its upper surface a peripheral flange 2 with a rounded inner sidewall portion to form a round recess inside the flange 2. The flange 2 has an outer sidewall of squared configuration to receive thereon a leg portion of a square-shaped front cover 13 of transparent material. It is within the round recess that said time dial 20 is disposed with the center portion being rotatably journaled on a hub 7 projecting upwardly from the center of the base plate 1. Along the periphery of the dial 20 are formed a plurality of evenly spaced holes 21 for removably receiving on-tripper 31 and off-tripper 32. A plurality of guide slots 22 are formed around the dial 20 to be radially in line with the respective holes 21. The on-tripper 31 has a pair of legs, one is a first actuator leg 33 and the other is a first guide leg 34, as the off-tripper 32 has a second actuator leg 35 and a second guide leg 36, these actuator legs and guide legs will fit respectively into hole 21 and guide slot 22 to fixedly position the respective trippers such that the actuator legs can extend downwardly through the hole 21 for actuating switch means 80, the detailed operation of which will be discussed hereinafter. Also disposed above the time dial 20 is a clock including a face plate 23 marked with time indicia, a minute hand 24, and a hour hand 25.

Figure 2:
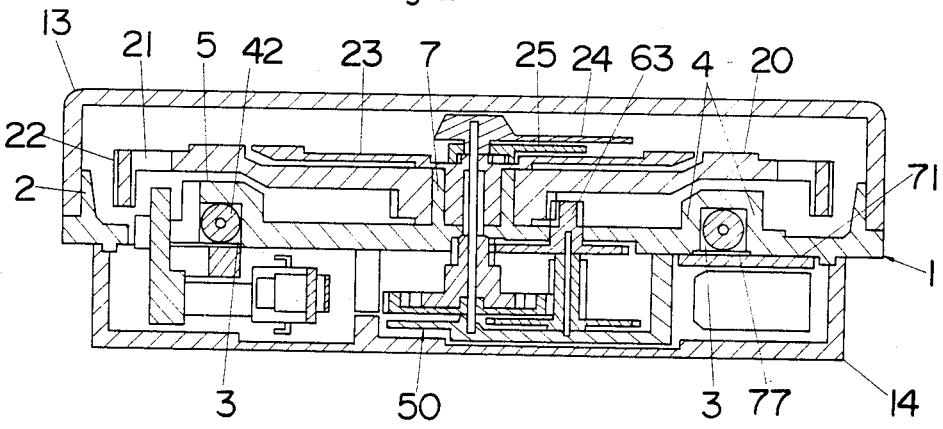
FIG. 2 is a cross sectional view taken along the line 2—2 of FIG. 1.
Figure 3:
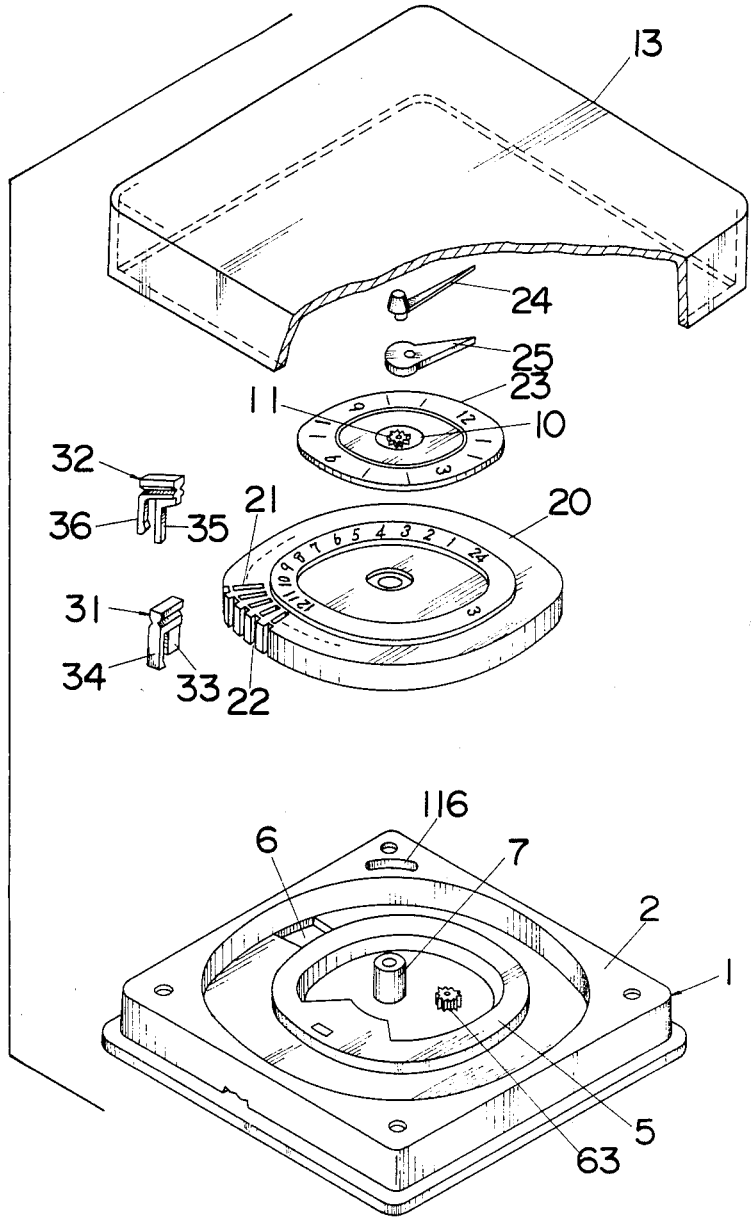
FIG. 3 is an exploded perspective view illustrating the parts disposed above a base plate of the time switch.
Figure 4:
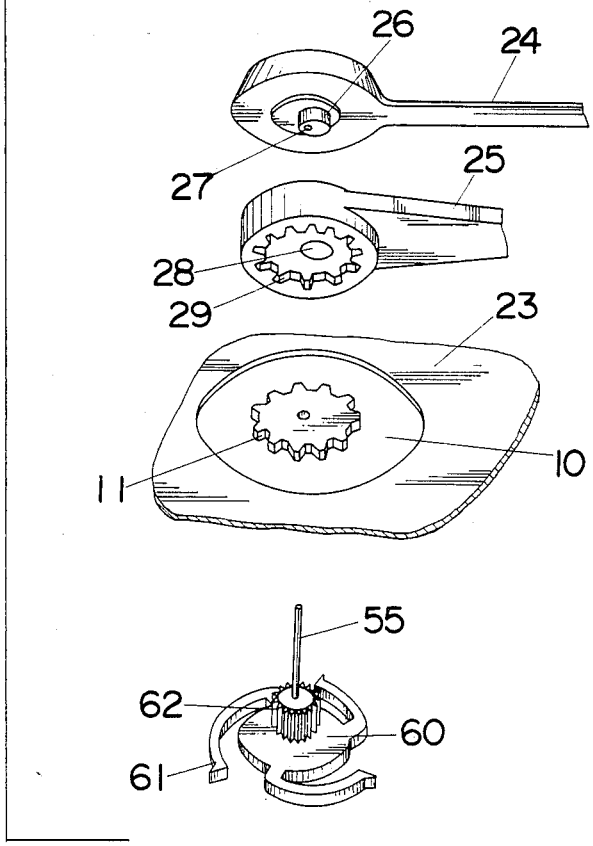
FIGS. 4 and 5 are an explanatory views respectively illustrating the driving mechanism connecting a hour hand to a minute hand included in the time switch.
Figure 6:
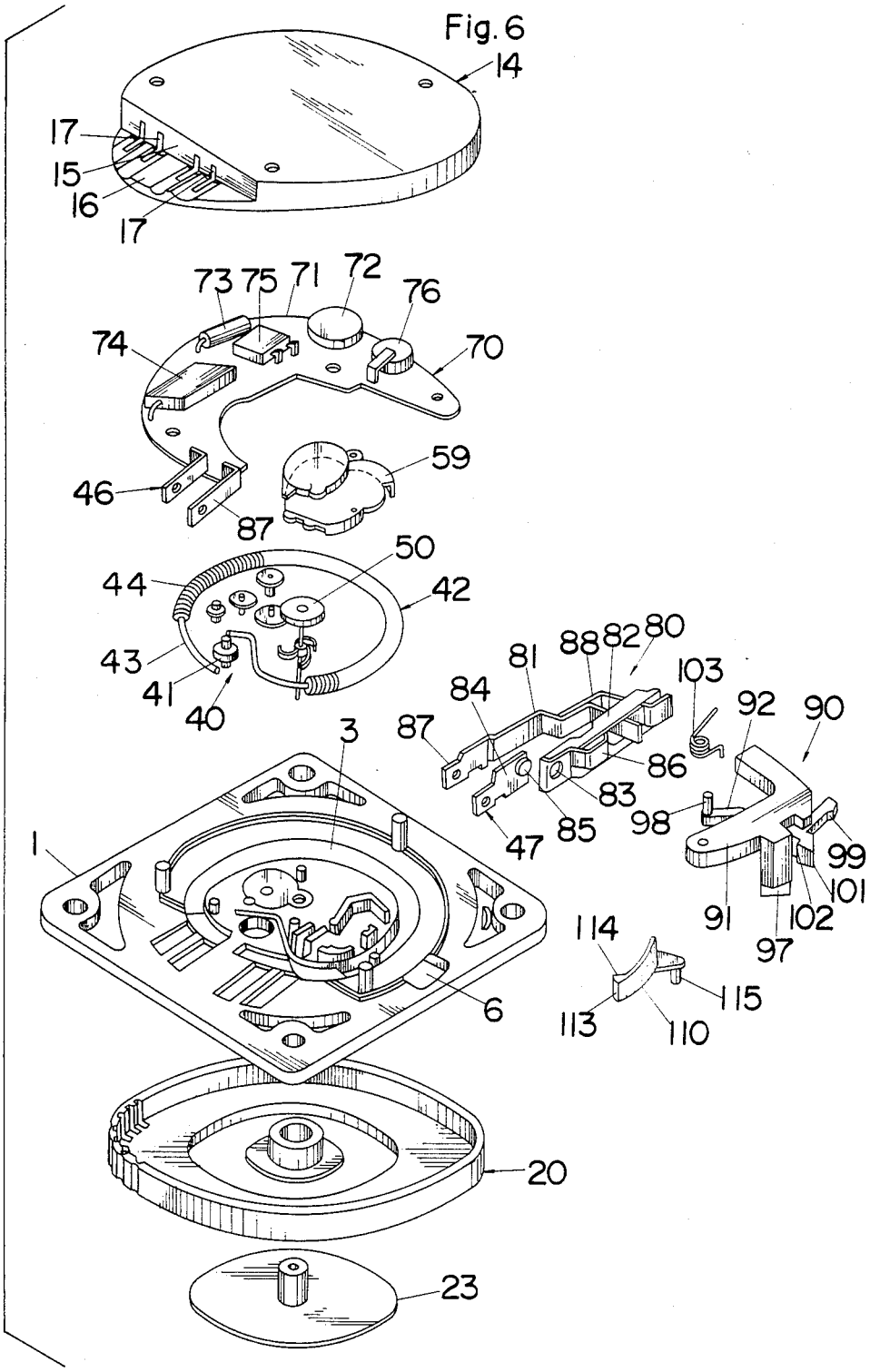
FIG. 6 is an exploded perspective view illustrating chiefly the components disposed below the base plate of the time switch.
Figure 7:
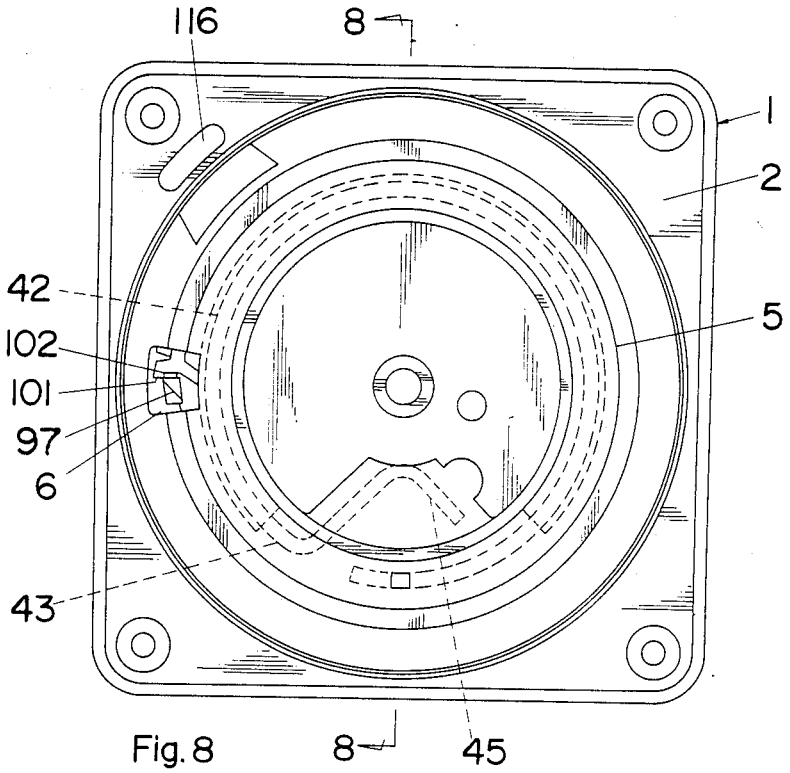
FIG. 7 is a plane view of the time switch with a time dial being removed.
Figure 8:
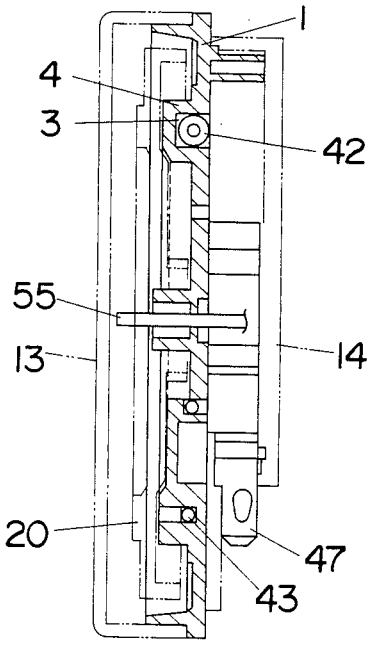
FIG. 8 is a cross sectional view taken along the line 8—8 of FIG. 7.
Figure 9:
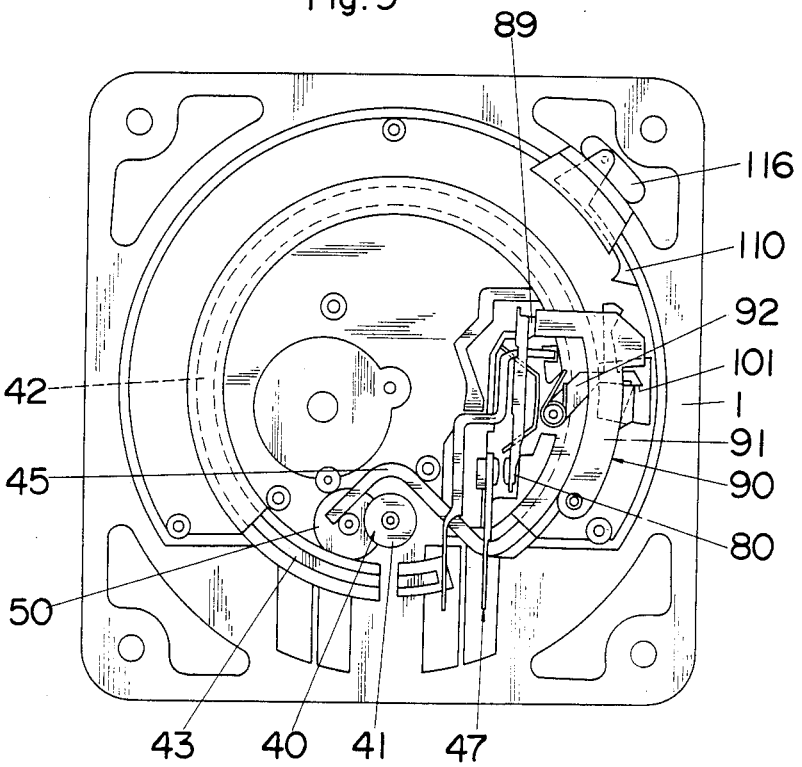
FIG. 9 is a rather schematic bottom view of the time switch with a back cap being removed.

Mounted on the undersurface of the base plate 1 are a rotor 41 of the motor 40, a reduction gear train 50, input terminal 46, output terminal 47, switch means 80 electrically connected between the input and output terminals, switch activating means 90, and electric circuit means 70 for energizing the motor 40. A back cap 14 is attached to the undersurface of the base plate 1 for enclosing the above components to be disposed below the base plate 1. Said motor 40 is composed of the rotor 41 which is a bipolarized permanent magnet and an electromagnet 42 which is formed by winding a coil 44 around a ring core 43 interrupted by a gap for the rotor 41, the rotor 41 being rotatably mounted on the undersurface of the base plate 1 and the electromagnet 42 being received within a generally annular groove 3 in the base plate 1 such that the electromagnet 42 will not be the cause for increasing the thickness of the motor 40 on the underside of the base plate 1. The annular groove 3 is formed, as best shown in FIGS. 2 and 6, between a pair of upwardly projecting opposed ribs 4 on the base plate 1 and has its upper end closed by the top wall integral with the ribs, the groove 3 being concentric with the time dial 20 to have a diameter slightly smaller than the dial 20 so as to leave at the portion outside the complementary annular projection 5 on the base plate 1 a space in which the lower portions of said trippers 31 and 32 are allowed to pass through during the rotation of the time dial 20, the detail of the operation of the above trippers will be discussed hereinafter. As shown in FIGS. 7 and 9, the one end portion of said ring core 43 is bent radially inwardly to form a generally V-shaped portion 45 with its opening facing outwardly, which is cooperative with the opposite end portion of the ring 43 to define the gap for the rotor 41. This configuration, combined with the fact that the electromagnet 42 can have a diameter nearly as large as the time dial 2, serves to develop sufficient power for the rotor 41 to drive the time dial 20 as well as to dispose the rotor 41 within the back cap 14 of generally D-shaped configuration.

Said electric circuit means 70, as shown in FIG. 6, includes a printed circuit board 71 on the undersurface or component side of which are mounted a quartz ocsillator 72, a resistor 73, a capacitor 74, rectifier 75, and a secondary or backup battery 76 to complete a circuit for receiving the electricity through said input terminal 46 and for producing an output pulse to drive the motor 40 stepwise, said quartz oscillator 72 comprising a flattened capsule to encapsulate sealingly a quartz crystal, an integrated circuit, a resistor, a trimming capacitor. Said printed circuit board 71 is arcuate to have the input terminal 46 fixed to its one end, and disposed fixedly on the undersurface of the base plate 1 with its upper surface or conducting side covered by an insulating sheet 77 (see FIG. 2).

Figure 10:
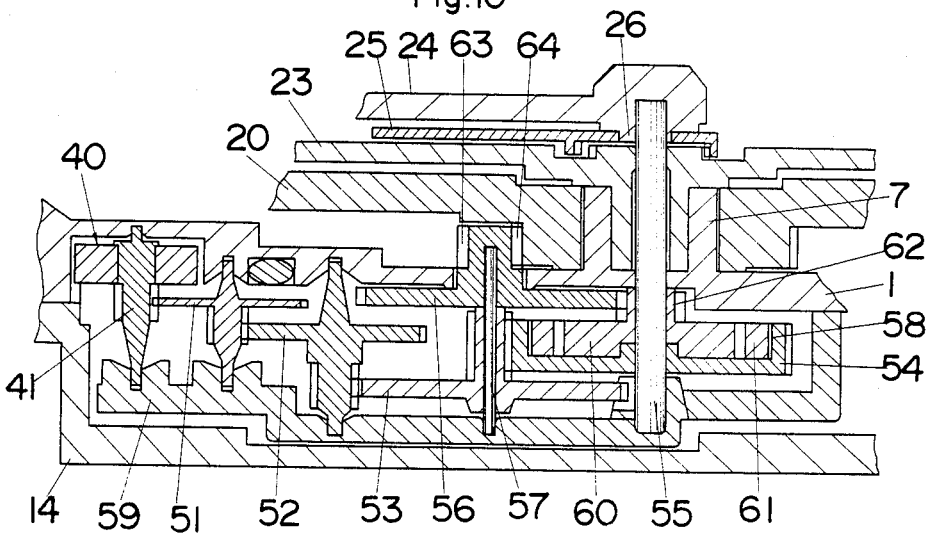
FIG. 10 is an enlarge fragmentary cross section illustrating a gear train leading from a rotor to a time dial of the time switch.
Figure 11:
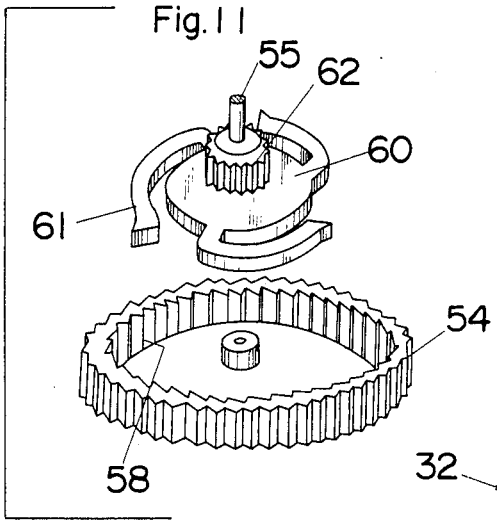
FIG. 11 is an enlarged exploded perspective view illustrating a minute gear and a clutch wheel employed in the time switch.

Referring now to FIGS. 6 and 10, there is illustrated the linkage of said gear train 50. The output of the rotor 41 is transmitted by means of intermediate gears 51, 52 and 53 to a minute gear 54 with a minute shaft 55 and to a dial drive gear 56 with a dial drive shaft 57. The minute shaft 55 is rotatably journaled on the base plate 1 and a gear supporting plate 59 opposed thereto for rotation in one direction together with the minute gear 54, the minute shaft 55 being located at the center of the base plate 1 with its upper end portion extended upwardly through the hub 7 so as to be the axis of rotation for the time dial 20. Said dial drive shaft 57 is rotatably journaled on the gear supporting plate 59 for rotation together with the dial drive gear 56. The minute gear 54 fits loosely on the minute shaft 55 and, as also shown in FIG. 11, has an internal spline 58 which meshes with pawls 61 of a clutch wheel 60 rotatively fixed onto the minute shaft 55, establishing between minute gear 54 and the minute shaft 55 an one-way drive connection which allows the minute shaft 55 to rotate in one direction and prevents it to rotate in the opposite direction. The clutch wheel 60 has an integral pinion 62 which engages the dial drive gear 56. Rotatable together with the dial drive gear 56 is a drive pinion 63 which extends upwardly through the base plate 1 for engagement with a gear 64 provided around the center portion of the time dial 20 such that the time dial 20 is driven to rotate in one direction about the minute shaft 55 by the motor 40 through said gear train 50.

Figure 5:
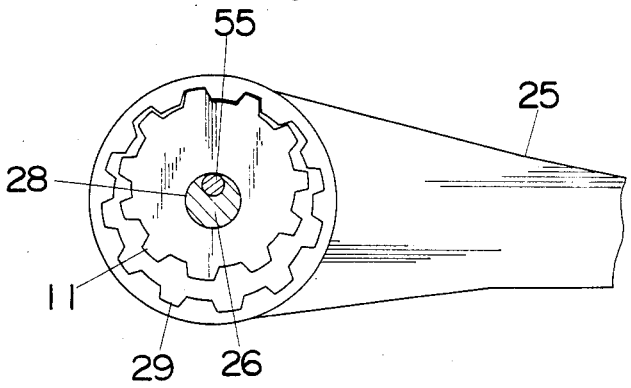

The mechanism for driving the clock will be discussed with reference to FIGS. 3 through 5, and 10. Said minute hand 24 is provided at its one end a downwardly projecting stud 26 with a bore 27 into which the upper end of the minute shaft 55 fits snugly for rotating the minute hand 24. This stud 26 is an eccentric cam with its axis displaced from the minute shaft 55 and rotatably journaled within a hole 28 formed at one end of the hour hand 25, whereby the hour hand 25 is coupled by a frictional coupling to the minute shaft 55 by means of the cam stud 26. Integral with hour hand 25 is an internal gear 29 having an axis concentric with the hole 28 and therefore eccentric to the minute shaft 55. Said face plate 23 is provided in its upper surface with an annular recess 10 which is concentric with the minute shaft 55 and which has an inner sidewall formed with a stationary gear 11 for engagement with said internal gear 29 so as to establish a planocentric drive connection (also referred to as harmonic drive connection) between the minute shaft 55 and the hour hand 25. That is, as shown in FIG. 5, the number of teeth of the internal gear 29 is larger than that of the stationary gear 11, whereby the internal gear 29 will vary its meshing point with the stationary gear 11 while the hour hand 25 is driven by the minute shaft 55 to perform an eccentrical rotating motion, and therefore the hour hand 25 will move one increment due to the difference in the number of teeth of the internal gear 29 and the stationary gear 11 for one complete revolution of the minute shaft 55 or the minute hand 24. With this arrangement that the gears employed for the planocentric drive are arranged within the recess 10 in the face plate 23, no additional space above and/or below the base plate 1 is required for the drive mechanism of the hour hand 25, maintaining the thickness of the whole time switch assembly at a minimum in spite of the clock with the hour hand 25 being added.

Figure 13:
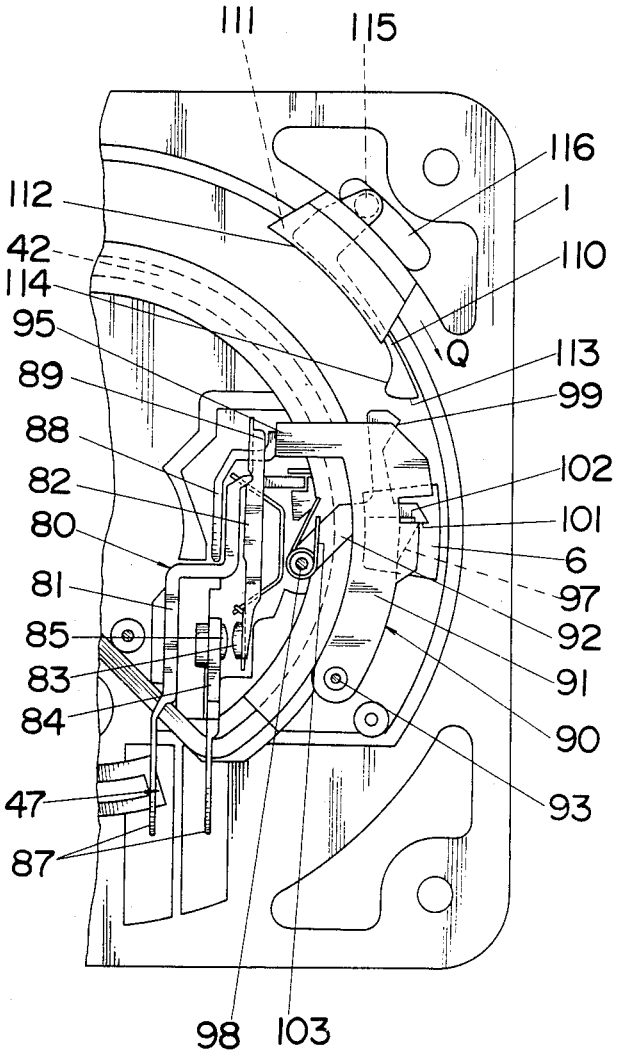
FIG. 13 is an enlarged fragmentary bottom view illustrating the operation of the switch actuating means and the operation of a manual switch handle provided on the time switch.

Said switch means 80 is a momentary action normally open switch which comprises, as shown in FIG. 13, a supporting member 81, movable arm 82 with a movable contact 83, a stationary member 84 with a fixed contact 85, and a leaf spring 86 for biasing the movable arm 82 in such a way that the movable contact 83 is urged away from the fixed contact 85, the supporting member 81, and the stationary member 84 having at their respective end portions integral connectors 87, such connectors 87 constituting said output terminal 47 as the input terminal being constituted likewise by connectors 87. The arm 82 is connected to the supporting member 81 by means of a lever 88 both ends of which are pivoted respectively to the supporting member 81 at the end portion opposite to the movable contact 83 and the movable arm 82, while the leaf spring 86 is secured to its both ends respectively to the movable arm 82 at portion adjacent to the movable contact 83 and the supporting member 81. The end portion 89 at which the movable arm 82 and the lever 88 are connected is a spot for receiving an operating force from the switch activating means 90, and when the operating force is applied to the spot, the arm 82 is forced toward the supporting member 91 against the biasing force of the spring 86 in a rather parallel motion due to said double-pivoted linkage to close the contacts 83 and 85.

Figure 12:
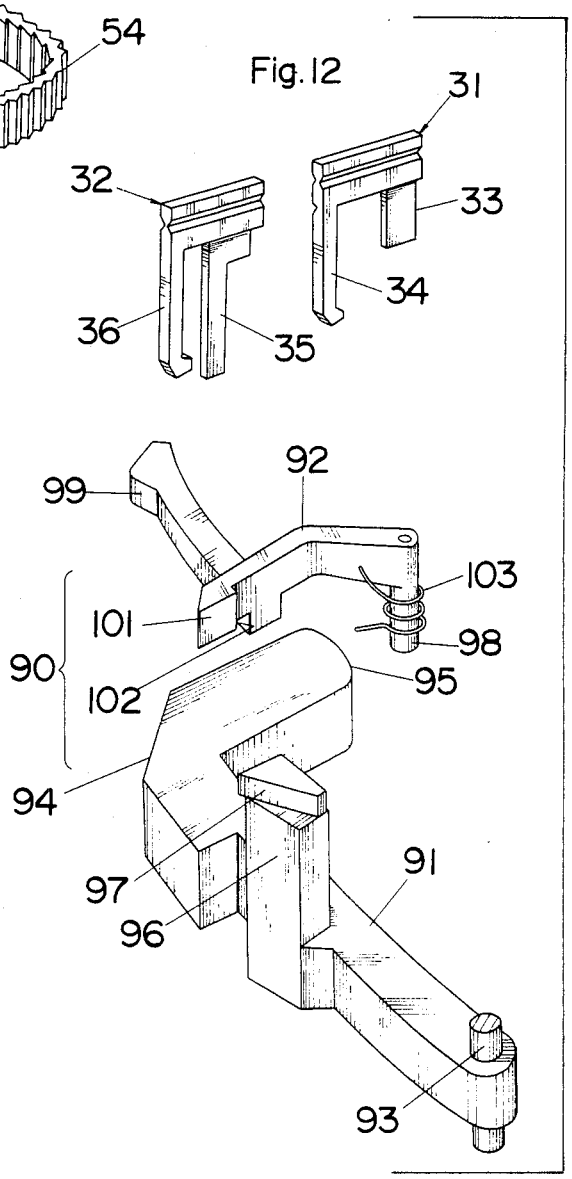
FIG. 12 is an enlarged exploded perspective view illustrating switch activating means, and an on-tripper and an off-tripper cooperative therewith respectively to close and open switch means of the time switch.

Referring to FIGS. 12 and 13, said switch activiating means 90 comprises an actuating lever 91 and a retaining lever 92, both mounted pivotally at different locations on the undersurface of the base plate 1. The actuating lever 91 is in the form of a generally L-shaped configuration when viewed in plane to have at its one end a pivot axis 93 journaled in the base plate 1 and to have at the opposite end portion a first trailing edge 94 and an actuator end 95 which is in contact with said switch means 80 at the portion 89. In the meanwhile, the base plate 1 is provided with an opening 6 at the portion below the peripheral portion of the time dial 20 through which the mechanical connection of the on-trippers 31 and off-tripper 32 with the switch activating means 90 can be achieved. Integral with and projecting upwardly from the portion intermediate both ends of said actuating lever 91 is a stem 96 the upper end of which extends through the opening 6 and has a first leading edge 97 located above the base plate 1. The actuating lever 91 thus constructed is movable about its pivot axis 93 between an on-position where the actuator end 95 pushes the movable arm 82 to close the contacts and an off-position where the movable arm 82 pushes back the actuator end 95 by the restoring force of said leaf spring 86 to open the contacts. Said retaining lever 92 is in the form of a generally Y-shaped configuration when viewed in plane to have at one end a pivot axis 98 journaled in the base plate 1 and have a pair of legs at the opposite end. One of the legs is located below the base plate 1 to have a second trailing edge 99 at its free end and the other has at its extremity a second leading edge 101 which extends through the opening 6 to be located above the base plate 1. A coil spring 103 around the pivot axis 98 urges the retaining lever 92 to rotate about the axis 98 in one direction. Said retaining lever 92 is further provided at its lower extremity with latching edge 102 which will engage the lower portion of said stem 96 of the actuating lever 91 when the lever 91 is pivoted to be in the on-position so as to retain the actuating lever 91 in that position. This engagement by the latching edge 102 is arrested by said biasing force of the coil spring 103 and is released when the off-tripper 32 is brought into contact with the second leading edge 101 of the retaining lever 92. The first leading edge 97 is normally positioned in the path in which said first actuator leg 33 of the on-tripper 31 will move during the rotation of the time dial 20, such that the actuating lever 91 is forced to be in the on-position to close the switch means 80 when the first actuator leg 33 comes into contact with the first leading edge 97 to cam thereover. At this occurrence, the actuating lever 91 is kept in that position by being locked by the retaining lever 92 as in the manner described above. The second leading edge 101 of the retaining lever 92, on the other hand, projects into the path for the second actuator leg 35 of the off-tripper 32 when it locks the actuating lever 91, such that the retaining lever 92 unlocks the actuating lever 91 or allows it to return to the off-position by the restoring force of the leaf spring 86 when the second actuator leg 35 comes into contact with the second leading edge 101 to move the retaining lever 92 against the biasing force of the coil spring 103 in the direction of disengaging the actuating lever 91 therefrom.

Said base plate 1 is further provided at its one corner portion with a manual switch handle 110 slidably received within an arcuate groove 111 defined by a guide rib 112 formed on the undersurface of the base plate 1. One end portion of the manual switch handle 110 is shaped to have a first trip end 113 and a second trip end 114 which are respectively cam members capable of being in contact respectively with said first trailing edge 94 of the actuating lever 91 and the second trailing edge 99 of the retaining lever 92. The other end portion of the manual switch handle 110 includes an upwardly extending knob 115 which is accessible through a window 116 in the base plate 1. The manual switch handle 110, when moved in the direction indicated by an arrow Q in the FIG. 13 along the arcuate path, make the first trip end 113 be in contact with the first trailing edge 94 so as to pivot the actuating lever 21 radially inwardly, whereby the switch means 80 is closed as in the same manner described above with reference to the operation of the on-tripper 31. At this time, the manual switch handle 110 is retained in position by a frictional engagement with said guide rib 112 and the actuating lever 91 is arrested in the on-position by said retaining lever 92. When the manual switch handle 110 is moved in the opposite direction from that position, the second trip end 114 will cam over the second trailing edge 99 of the retaining lever 92 to push it radially inwardly, whereby the retaining lever 92 unlocks the actuating lever 91 and allows it to return to the off-position to release the switch contacts 83 and 85. The manual switch handle 110 thus arranged to close and open the switch means 80 by using the same switch activating means 90, is found to be useful in that it can perform functional a test of the switch activating means 90.

Figure 14:
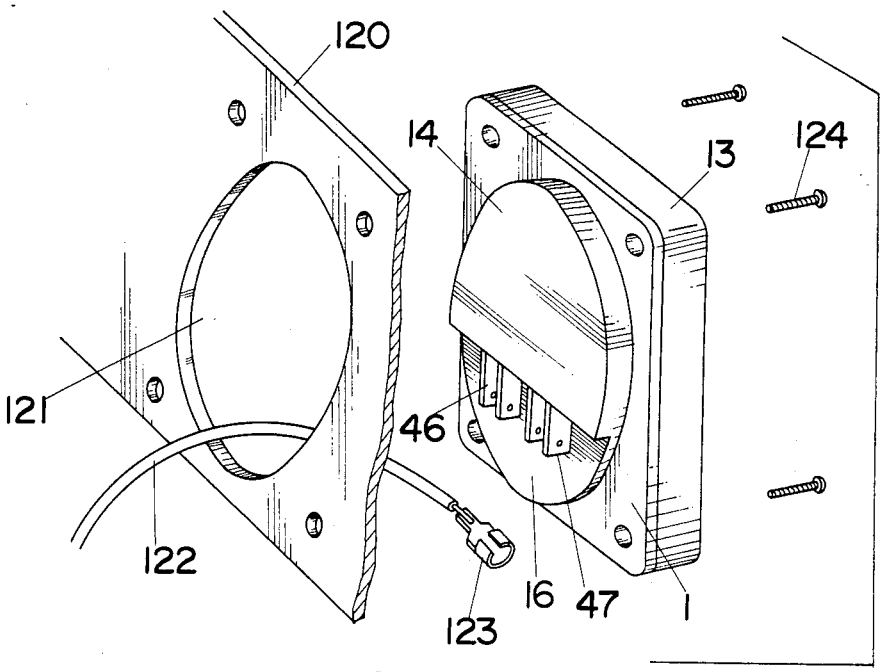
FIGS. 14 and 15 are respectively perspective views illustrating a panel and the time switch to be mounted thereon.
Figure 15:
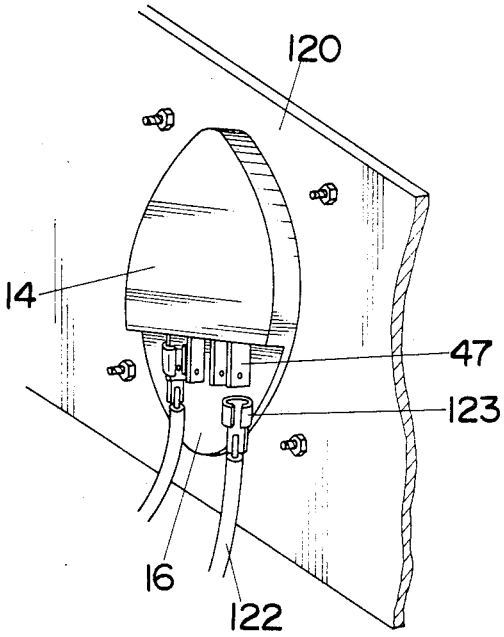

Turning back to FIG. 6, said back cap 14 attacted to the undersurface of the base plate for enclosing the components disposed therebelow is formed to have a generally D-shaped configuration when viewed in plane contoured by a circle interrupted by a chord. Extending from the upper edge of the chord portion 15 of the cap 14 is a flange 16 with an arcuate edge which is cooperative with the outer periphery of the cap 14 to form the circumference of the circle concentric with the base plate 1. Two sets of slits 17 are formed in the cap 14 at the juncture of the chord portion 15 and the flange 16 for the connectors of the input terminal 46 and the output terminal 47. These connectors extending through the respective slits 17 are disposed just below the flange 16 so as not to project beyond the bottom of the back cap 14. In most cases, the time switch is in use to be installed on a panel 120 as illustrated in FIGS. 14 and 15, such panel being a control panel provided independently of an electric device to be controlled by the time switch or a face panel of the electric device. An advantageous feature of the above configuration of the back cap 14 is to facilitate the installation of the time switch on the panel 120, since the back cap 14 with the circular contour can well fit into a rounded hole 121 which is the simplest one requiring no complicated processing and therefore can be drilled more easily for example than any square holes. The numeral 122 in the figures designates a lead wire with a fastening terminal 123 connected by insertion to said output and input terminals 46 and 47, the numeral 124 designates screws extending through holes in the base plate 1 to mount the time switch on the panel 120.

Figure 16:
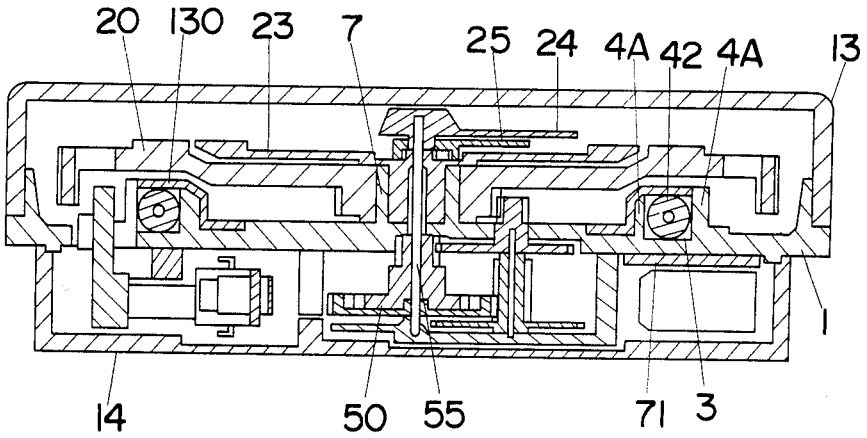
FIG. 16 is a cross sectional view illustrating a modification of the above embodiment corresponding to FIG. 2.

Referring to FIG. 16, there is illustrated a modification of the above embodiment which is similar to the above embodiment except that the annular groove 3 in the base plate 1 is closed at its bottom. The groove 3 is defined by a pair of upwardly projecting opposed rib 4A integral with the base plate 1 to have an lower end closed by the base plate 1 itself and to leave at the upper end an opening through which the electromagnet 42 is inserted, the upper opening being dlosed after the insertion of the electromagnet 42 by a retainer 130 secured to the base plate 1. With this structure of the annular groove 3 being closed at its bottom by the base plate 1, the insulating sheet 77 required for insulating the electromagnet 4 from the conducting side of the printed circuit board 71 as in the above embodiment will be no more necessary, facilitating the assembly of the timer switch as well as to reducing the thickness of the time switch by this insulating sheet.

The above embodiments and particularly the drawings are set forth for purposes of illustration only. It will be understood that many variations and modifications of the embodiment herein described will be obvious to those skilled in the art, and may be carried out without departing from the spirit and scope of the invention.

I claim:

1. A time switch driven by an electric clock motor comprising:

a base plate provided with an input terminal, an output terminal, and the clock motor comprising a rotor which is a bipolarized permanent magnet rotatably journaled on the base plate and an electromagnet ring, said rotor being disposed below the base plate;

a time dial overlying and rotatably mounted on the base plate to be driven by the motor;

electrical circuit means disposed below the base plate to energize the motor;

switch means disposed below the base plate;

a reduction gear train disposed below the base plate for interconnecting the rotor of the motor and the time dial;

switch activating means disposed below the base plate for opening and closing the switch means;

at least one on-tripper mounted on the time dial to be movable therewith so as to operate the switch activating means to open the switch means when it comes into contact with the switch activating means;

at least one off-tripper mounted on the time dial to be movable therewith so as to operate the switch activating means to close the switch means when it comes into contact with said switch activating means;

said electromagnet ring being composed of a ring core interrupted by a gap within which said rotor is disposed and a coil would therearound said ring core;

said base plate having an annular groove for receiving therein said electromagnet;

said groove being coaxial with said time dial and having a diameter slightly smaller than that of the dial; and the components for the electrical circuit means, the switch means, the switch activating means, and the reduction gear train being arranged substantially in the same plane parallel to the base plate.

2. A time switch as set forth in claim 1, wherein the one end portion of the ring core is bent radially inwardly to form a generally V-shaped portion with its opening facing radially outwardly, said V-shaped portion being cooperative with the opposite end portion of the core ring to define therebetween the gap for the rotor.

3. A time switch as set forth in claim 1, including a clock with a face plate, an hour hand, a minute hand, and a minute shaft driven by the motor through the reduction gear train and extending upwardly through the base plate and the face plate, said face plate overlying and concentric with the time dial to have a smaller diameter than the time dial and to be rotatively fixed to the base plate, said minute hand being fixed to the base plate, said minute hand being fixed to the upper end of the minute shaft to be rotated thereabout, said hour hand overlying the face plate and being coupled to the minute shaft by a frictional coupling which permits the hour hand to rotate eccentrically about the minute shaft, said face plate being provided in its upper surface with an annular recess which is concentric with the minute shaft and which has on its inner wall a stationary gear engaging an internal gear formed on the hour hand, the axis of the internal gear being eccentric to the minute shaft to establish a planocentric driving connection between the stationary and internal gears such that the hour hand moves one increment for each revolution of the minute hand.

4. A time switch as set forth in claim 1, wherein said switch activating means comprises an actuating lever and a retaining lever both pivoted to the base plate, said actuating lever having an actuator end for closing the switch menas and having a first leading edge which lies in the round path made by the on-tripper during the rotation of the time dial such that when the first leading edge is brought into contact with the on-tripper the actuating lever is pivoted by the on-tripper against a biasing force of spring means to be brought into an on-positon where said actuator end closes the switch means, and said retaining lever having a latching edge and a second leading edge, said latching edge engageable with a portion of the actuating lever when moved in the on-position to lock the same in that position, and said second leading edge lying in the round path made by said off-tripper during the rotaion of the time dial such that the retaining lever is forced by the off-tripper to pivot in the direction of disengaging the actuating lever therefrom when the second leading edge is brought into contact with the off-tripper, whereby the actuating lever returns by the restoring force of the spring means to an off-position where the actuator end release the switch means to open.

5. A time switch as set forth in claim 4, including a manual switch handle adapted to be received within an arcuate path formed in the base plate so as to be movable along the arcuate path lying along a part of the periphery of the time dial, said manual switch handle having a first trip end and a second trip end, the first trip end being capable of being in contact with a first trailing edge provided on said actuating lever so as to pivot the actuating lever into the on-position when the manual switch handle is moved in one direction along the path, and the second trip end being capable of being in contact with a second trailing edge provided on said retaining lever so as to pivot the retaining lever in the direction of disengaging the actuating lever therefrom and to return the actuating lever in the off-positon when the manual switch handle is moved in the opposite direction.

6. A time switch as set forth in claim 1, including a back cap for enclosing the components disposed below the base plate, said cap being formed in a generally D-shaped configuration contoured by a circle interrupted by a chord to define at the portion outwardly of the chord a relatively recessed portion in which said input terminals extend through the cap wall.

7. A time switch as set forth in claim 1, wherein said annular groove is defined between a pair of upwardly extending opposed ribs to have its bottom closed by the base plate itself and to have an open top through which said electromagnet can be inserted.

* * * * *